US007281506B2

(12) United States Patent
Maeyama et al.

(10) Patent No.: US 7,281,506 B2
(45) **Date of Patent: *Oct. 16, 2007**

(54) OIL PRESSURE CONTROL APPARATUS FOR AN INTERNAL COMBUSTION ENGINE

(75) Inventors: Akinobu Maeyama, Zama (JP); Masanori Koda, Sagamihara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/020,248

(22) Filed: Dec. 27, 2004

(65) Prior Publication Data

US 2005/0103191 A1 May 19, 2005

Related U.S. Application Data

(63) Continuation of application No. 10/665,499, filed on Sep. 22, 2003, now Pat. No. 6,848,404, which is a continuation of application No. 09/986,782, filed on Nov. 9, 2001, now Pat. No. 6,622,673, which is a continuation of application No. 09/577,620, filed on May 25, 2000, now Pat. No. 6,382,148.

(30) Foreign Application Priority Data

Jun. 10, 1999 (JP) ..... 11-163584
Jun. 23, 1999 (JP) ..... 11-176978

(51) Int. Cl.
*F01L 1/34* (2006.01)

(52) U.S. Cl. ..... 123/90.17; 123/90.12; 123/90.33

(58) Field of Classification Search ..... 123/90.15, 123/90.16, 90.17, 90.18, 90.27, 90.31, 90.12, 123/90.13, 90.33, 90.34, 90.44; 464/1, 2, 464/160

See application file for complete search history.

(56) References Cited

U.S. PATENT DOCUMENTS 3,247,967 A 4/1966 Kucmerosky
3,412,720 A 11/1968 Binder
3,597,921 A 8/1971 McBurnett (Continued)

FOREIGN PATENT DOCUMENTS

JP 62-172874 11/1987

(Continued)

*Primary Examiner*—Ching Chang
(74) *Attorney, Agent, or Firm*—Sughrue Mion Pllc.

(57) ABSTRACT

An oil pressure control apparatus which includes a source of hydraulic pressure introducing the hydraulic pressure to a hydraulic actuator which is actuated by hydraulic pressure, a fluid passage which is connected between the source of hydraulic pressure and the hydraulic actuator for introducing and discharging hydraulic pressure from the source of hydraulic pressure to the actuator, a control valve which is disposed in the fluid passages for controlling the hydraulic pressure and a filter is disposed in a position that is between the actuator and the control valve. Thereby, the control valve is capable to be operated smoothly.

18 Claims, 9 Drawing Sheets

U.S. PATENT DOCUMENTS 3,708,977 A 1/1973 Raymond
3,721,293 A 3/1973 Ahlstone et al.
3,744,244 A * 7/1973 Swoager ..... 60/454
3,885,389 A 5/1975 Hull
5,003,937 A 4/1991 Matsumoto et al.
5,062,454 A 11/1991 Ichihashi et al.
5,195,864 A 3/1993 Drake et al.
5,335,495 A 8/1994 Sato et al.
5,363,817 A * 11/1994 Ikeda et al. ..... 123/90.15
5,535,588 A 7/1996 Peterson et al.
5,600,955 A 2/1997 Sahinkaya
5,738,053 A 4/1998 Kato
5,797,361 A 8/1998 Mikame et al.
5,908,367 A 6/1999 Tominaga et al.
5,937,808 A * 8/1999 Kako et al. ..... 123/90.15
6,085,708 A 7/2000 Trzmiel
6,135,077 A 10/2000 Moriya et al.

FOREIGN PATENT DOCUMENTS

JP 2-24011 2/1990
JP 7-42402 8/1995

* cited by examiner

OIL PRESSURE CONTROL APPARATUS FOR AN INTERNAL COMBUSTION ENGINE

CROSS-REFERENCE TO RELATED APPLICATIONS

This is a continuation of Application Ser. No. 10/665,499 filed Sep. 22, 2003, now U.S. Pat. 6,848,404 which is a Continuation of Application Ser. No. 09/986,782, now U.S. Pat. No. 6,622,673 filed Nov. 9, 2001, which is a Continuation of Application Ser. No. 09/577,620 now U.S. Pat. No. 6,382,148 filed May 25, 2000. The entire disclosure of the prior application, application Ser. No. 10/665,499 is considered part of the disclosure of the accompanying Continuation application and is hereby incorporated by reference.

BACKGROUND OF THE INVENTION

This invention relates to an oil pressure control apparatus, and in particular an oil pressure control apparatus used for a valve timing control device that controls a timing of opening and closing of an intake or an exhaust valve of an internal combustion engine in accordance with engine operating conditions. Many different types of hydraulic actuator, as a operating valve timing control device, have been proposed. One such hydraulic actuator includes a source of hydraulic pressure and a control valve that is disposed between the source of the hydraulic pressure and the hydraulic actuator for controlling the hydraulic pressure introduced into the hydraulic actuator from the source of the hydraulic pressure. The control valve comprises a valve body, having a plurality of ports that are opened on external surface thereof, that is connected to the hydraulic actuator and the source of the hydraulic pressure. The control valve also includes a valve spool, which is slidably received in an internal chamber of the valve body for opening and closing the ports, and is operated by a plunger that is actuated by an electro-magnetic coil. A conventional device embodying this kind of the oil pressure control apparatus is disclosed, for example, in Japanese unexamined publication (koukai) 6-330712. The hydraulic actuator also comprises a filter that is disposed between the source of the hydraulic pressure and the control valve so as to prevent foreign matter from being introduced into the control valve in order to avoid accidental operation of the control valve. As an example, U.S. Pat. No. 5,797,361, such a filter is only disposed between the source of the hydraulic pressure and the control valve. Therefore, this conventional device is capable of filtering the oil from the source of the hydraulic pressure, but it is not capable of filtering the oil circulating through the hydraulic actuator. In this case, if foreign matter is present in the hydraulic actuator, it would be trapped in the oil circulating through the hydraulic actuator and might be introduced into the control valve. In addition, in this case, the foreign matter flowing together with the oil might cause the accidental operation of the control valve.

SUMMARY OF THE INVENTION

It is, therefore, an object to the present invention is to provide an improved an oil pressure control apparatus for an internal combustion engine which achieves high operational reliability and high efficiency for assembly.

In order to achieve the object, there is provided the oil pressure control apparatus, includes a source of hydraulic pressure introducing the hydraulic pressure to a hydraulic actuator, which is actuated by hydraulic pressure, a fluid passage which is connected between the source of hydraulic pressure and the hydraulic actuator for introducing a hydraulic pressure from the source of hydraulic pressure to the hydraulic actuator, a control valve which is disposed in the fluid passages for controlling the hydraulic pressure, and a first filter disposed in a fluid communication between the hydraulic actuator and the control valve.

DETAILED DESCRIPTION OF THE PREFERRED EMBODIMENT OF THE INVENTION

An oil pressure control apparatus, and in particular an oil pressure control apparatus used for a valve timing control device in accordance with preferred embodiments of the present invention, will be described with reference to the Figures.

Figure 1:
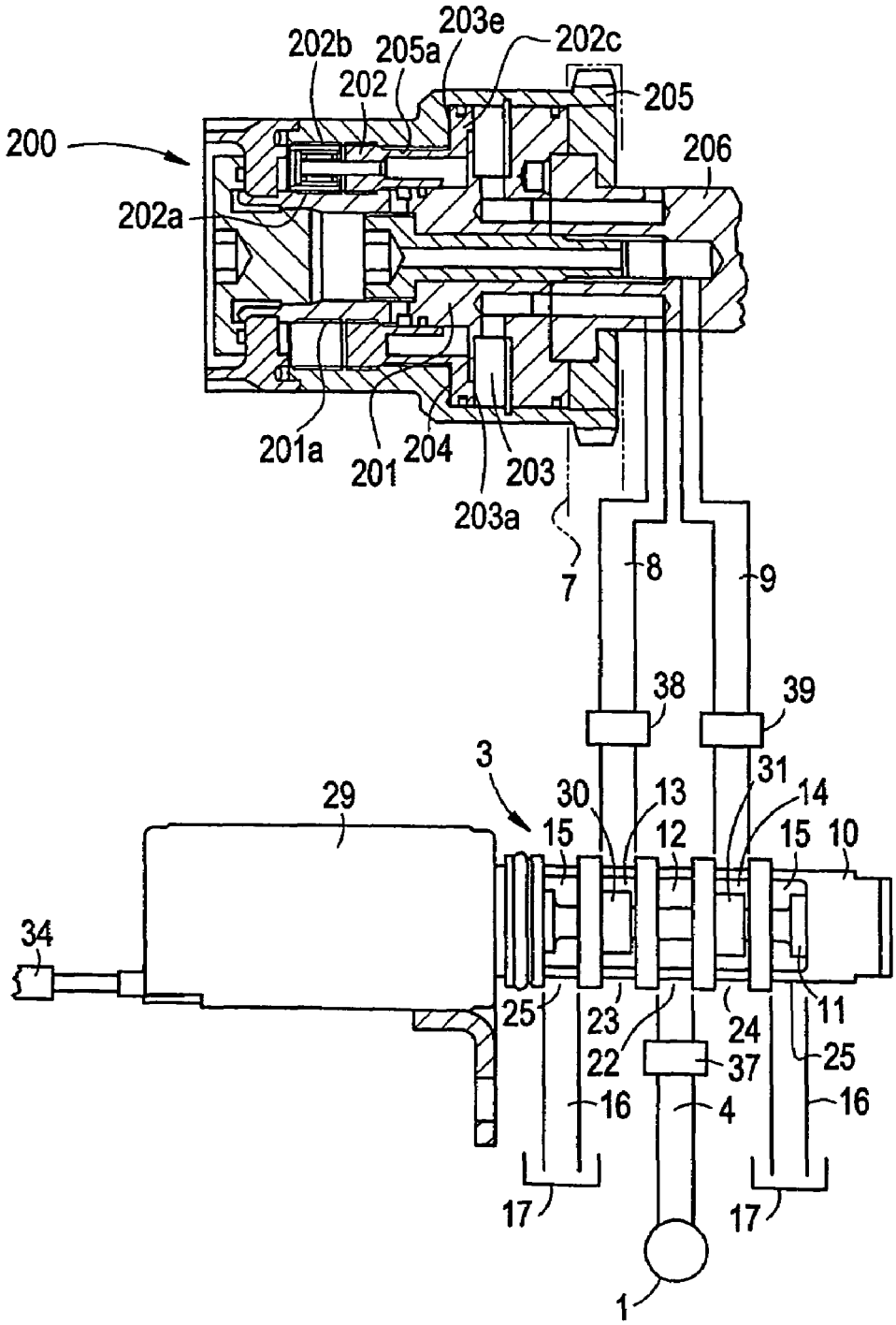
FIG. 1 is a combination of a schematic system and device sectional drawing, showing a hydraulic actuator as a valve timing control device in accordance with the first embodiment of the present invention.

FIG. 1 illustrates in schematic form the oil pressure control apparatus, especially applied to the valve control device for an internal combustion engine. An oil pump 1, as a source of hydraulic pressure, supplies working fluid to an actuator 200, as the valve timing control device, through an oil supply passage 4. A control valve 3, which is disposed between the pump 1 and the actuator 200, controls the supplying and discharging of working fluid to the actuator 200 from the pump 1.

The actuator 200 comprises a camshaft 206, which is journalled on a cylinder head (not shown) and has a cam lobe (not shown) for opening and closing intake and/or exhaust valves, and a sprocket 205 driven by a timing chain 7 for receiving a torque from an engine crankshaft (not shown) and synchronously rotated therewith. The sprocket 205 includes an inner helical gear 205*a* at an inner peripheral surface thereof. A sleeve 201, having an outer helical gear 201*a*, is firmly connected to the end of the camshaft 206. A ring gear 202 includes an inner helical gear 202*a* for engaging the outer helical gear 201*a* of the sleeve 201 and an outer helical gear 202*b* for engaging the inner helical gear 205*a* of the sprocket 205. Accordingly, a rotation of the engine crankshaft is transmitted to the camshaft 206 for opening and closing valves. First and second pressure chambers 203, 204 are formed in the sprocket 205, which are communicated to first and second passages 8, 9, respectively. Namely, the first and second passages 8,9 are formed in the cylinder head, the sleeve 201 and the camshaft 206 and are connected to respective pressure chambers 203, 204 and the control valve 3. The ring gear 202 has a piston portion 202*c* pressurized by working oil that faces the first and the second pressure chambers 203, 204 for moving the piston portion 202*c* in the direction of the axis thereof, so that the camshaft 206 is capable of rotating with respect to the sprocket 205. Therefore, the timing of the opening and closing of valves are varied in accordance with the engine condition.

Figure 2:
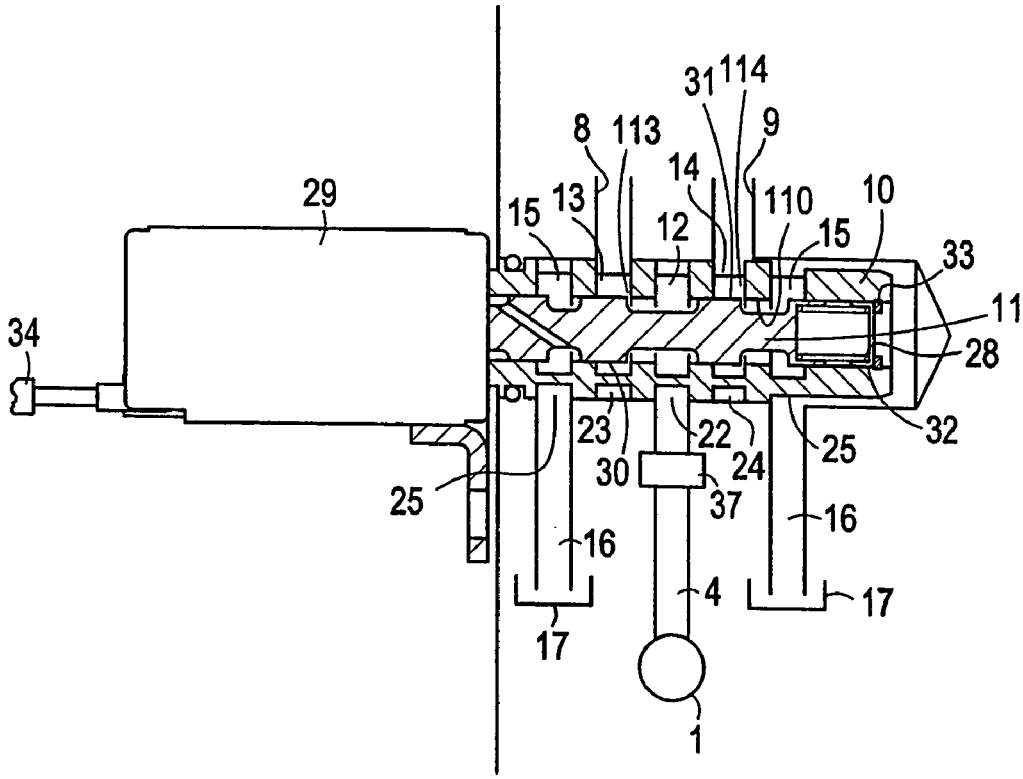
FIG. 2 is a sectional view of a control valve in FIG. 1.
Figure 3:
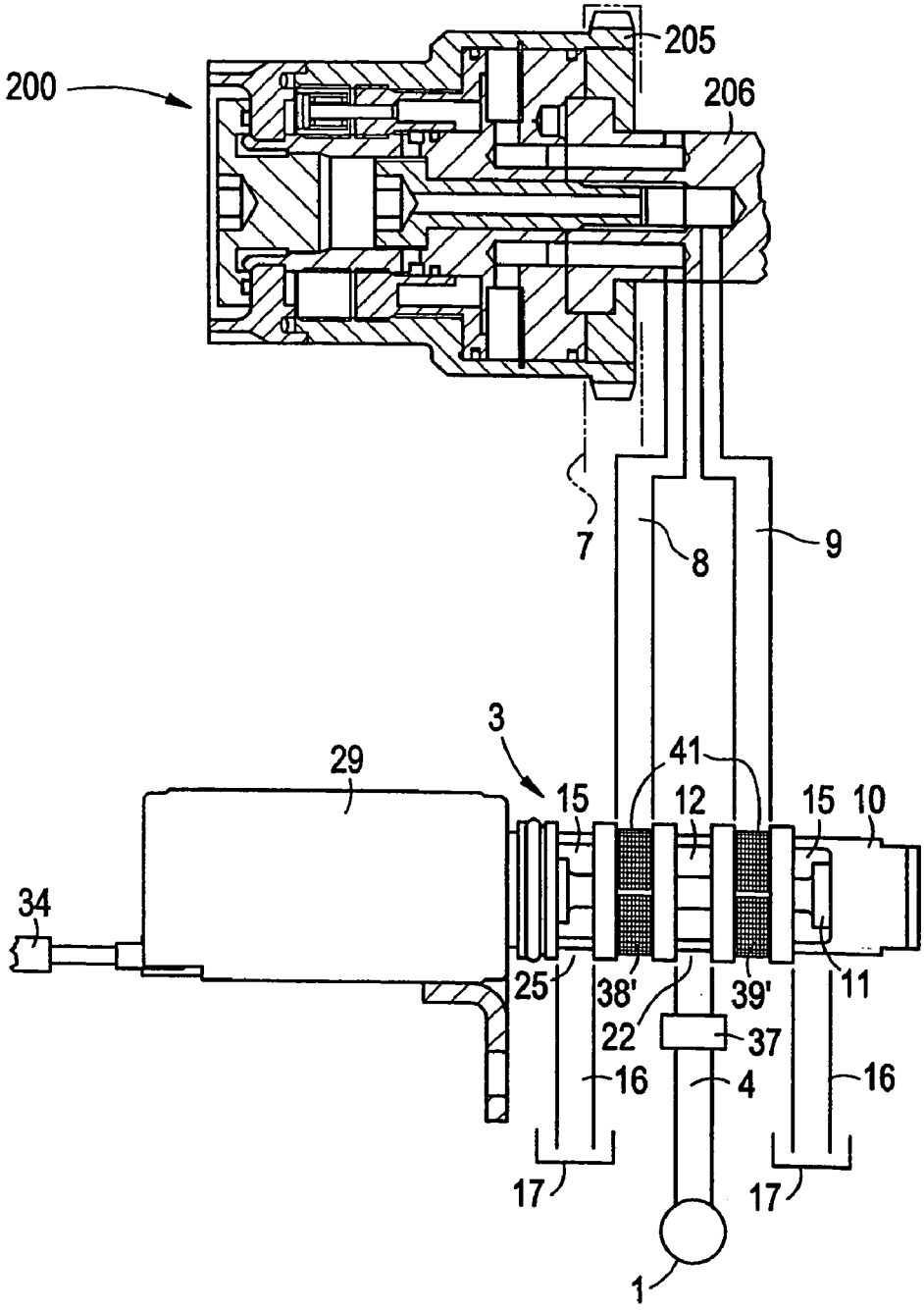
FIG. 3 is a combination of a schematic system and device sectional drawing, showing a hydraulic actuator as a valve timing control device in accordance with the second embodiment of the present invention.
Figure 4:
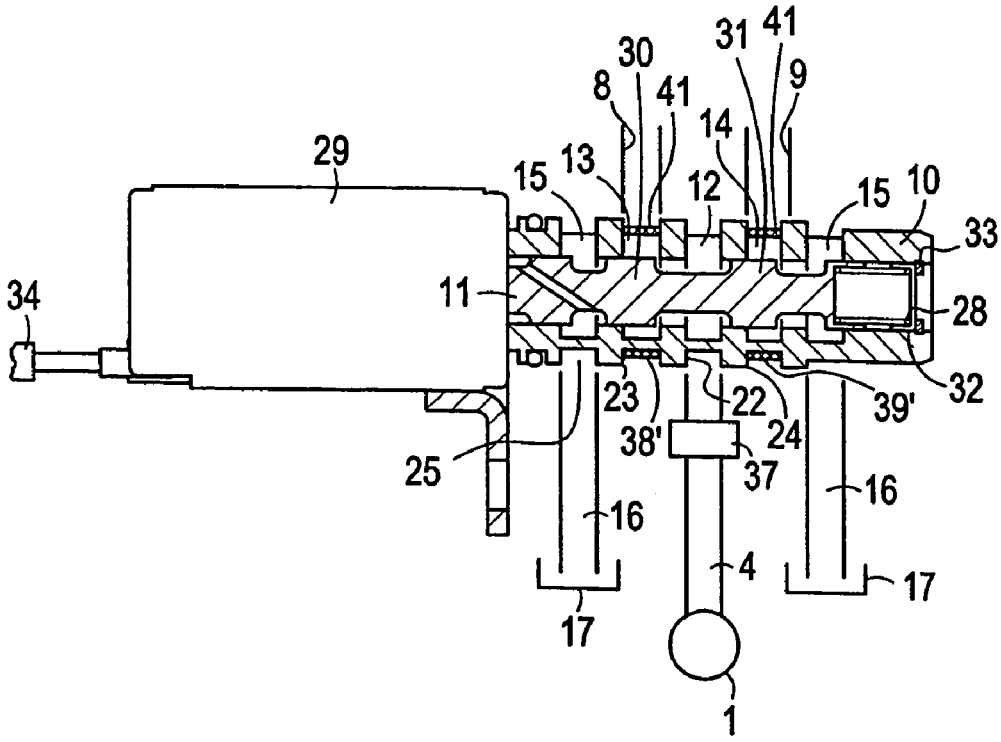
FIG. 4 is a sectional view of a control valve in FIG. 3.

The control valve 3 comprises a valve body 10 having an inner cylindrical portion 110 and a valve spool 11 that is slidably inserted into the cylindrical portion 110. The valve body 10 is received in an accommodating bore formed in an engine housing such as a cylinder head, an engine block and a cam cap that supports rotatably an upper surface of the camshaft bearing. The valve body 10 comprises a first port 13, and a second port 14 that are connected to the first and second passages 8, 9, respectively, and a supply port 12 that is communicated with the pump 1 through a supply passage 4. Also, the valve body 10 includes drain ports 15 that are communicated with a reservoir tank 17 through drain passages 16, respectively. The supply 12, first port 13, second port 14 and drain ports 24, 25 are opened to slots 22, 23, 24, 25 formed around an outer peripheral of the valve body 10, respectively. As shown in FIG. 2, a coil spring 28 is disposed between the end of the valve spool 11 and a retainer 32 for biasing the valve spool 11 toward an electro-magnetic solenoid 29. The retainer 32 is retained in the inner cylindrical portion 110 of the valve body 10 by the C-ring 33. The electro-magnetic solenoid 29 having a terminal 34 is connected to a controller (not shown) and a battery (not shown) for actuating the spool valve 10 in accordance with engine conditions. The valve spool 11 is provided with first and second lands 30, 31. The valve spool 11 is actuated by the electro-magnetic solenoid 29 within the inner cylindrical portion 110 of the valve body 10 for opening and closing the supply port 12, the first port 13, the second port 14 and the drain ports 15 with the first and second lands 30, 31. Namely, the first land 30 is capable of switching a fluid communication among the supply passage 4, the first passage 8 and the drain passage 16. The second land 31 is also capable of switching a fluid communication among the supply passage 4, the second passage 9 and the drain passage 16. The entire contents of U.S. Pat. No. 5,150,671, so-called "a gear valve timing device" type, is herein incorporated by reference as the actuator 200 and the control valve 3. First filters 38, 39 are disposed in the first and second passages 8, 9, respectively, and a second filter 37 is also disposed in the supply passage 4. Namely, the first filters 38, 39 are disposed in a fluid communication between the actuator 200 and the control valve 3, and the second filter 37 is disposed in a fluid communication between the pump 1 and the control valve 3.

The operation of the oil pressure control apparatus having the above structure will now be described.

Referring first to FIG. 1 and FIG. 2, when the electro-magnetic solenoid 29 is not energized, the valve spool 11 is biased in the left direction by means of the coil spring 28 and is positioned in the leftmost position. In this leftmost position of the spool valve 11, the first land 30 opens the supply port-side 113 of the first port 13 in a certain opening-area, and the second land 31 opens the drain port-side 114 of the second port 14 in a certain opening-area. Therefore, the working fluid, which is introduced to the valve body 10 from the pump 1 through the supply passage 4, is supplied to the first pressure chamber 203 by way of the first port 13 and the first passage 8. Also, the second passage 9 is connected to the reservoir 17 through the second port 14, the drain port 15, and the drain passage 16. Thereby, the hydraulic pressure is applied to the first pressure chamber-side of the piston 203*d*, and the ring gear 202 moves to the left-side, causing a change in the relative phase angle between the sprocket 205 and the camshaft 206, so that opening and closing timing of the valves are changed. Namely, FIG. 1 shows that the phase angle of the camshaft 206 is advanced relative to that of the sprocket 205.

On the other hand, when the electro-magnetic solenoid is energized, the spool 11 is moved in the right-side direction of FIG. 2. In this case, the first land 30 opens the drain-side of the first port 13 in a certain opening-area and the second land 31 opens the supply-side of the second port 14 in a certain opening-area. Therefore, the working fluid is introduced to the valve body 10 from the pump 1 through the supply passage 4, and is supplied to the second pressure chamber 204 by way of the second port 14 and the second passage 9. Also, the first passage 8 is connected to the reservoir 17 through the drain passage 16. Thus, the working oil is applied to the second pressure chamber-side of the piston 203*e*, and the ring gear moving to the right-side in FIG. 1 causes the generation of a relative phase angle between the sprocket 205 and the camshaft 206. Thereby, the opening and the closing timing of the valves are changed, that is, the phase angle of the camshaft 206 is retarded relative to that of the sprocket 205.

Moreover, when the valve spool 11 is in the neutral position so as to block the first and second ports 13, 14 with the first and second lands 30, 31, the relative phase angle between the sprocket 205 and the camshaft 206 is capable of being maintained at preferred relative phase angle.

In this embodiment, the working fluid passing through the control valve 3 is filtered by the first filters 38, 39 disposed in the first and second passages 8, 9, and the second filter 37 disposed in the supply passage 4, respectively. Moreover, the working fluid draining from the actuator 200 is also filtered by the first filters 38, 39. Namely, the working fluid introduced to the control valve 3 from the pump 1 is filtered by the second filter 37, and the working fluid draining from the actuator 200 to the control valve is filtered by the filters 38, 39. Thereby, these filters 38, 39 are capable of filtering out the foreign matter, such as metal shavings that are generated in the actuator 200 and trapped in the working fluid. Thus, the filters 38, 39 prevent the foreign matter from being introduced to the control valve 3 and prevent jamming of the foreign matter at the positions that are between the lands 30, 31 and the inner portion of the valve body 10. Therefore, the control valve 3 may be operated smoothly because of filtered clean working fluid.

Furthermore, in this embodiment, the actuator 200 is used as a valve timing control device, because the camshaft is subject to an alternating torque of the valve springs. Namely, when a cam makes the valve open against a valve spring force, the valve spring force urges against the cam in a direction opposite to its rotation. On the other hand, when the cam makes the valve close, the valve spring exert its spring force on the cam in the direction of its rotation. As a result, the camshaft 206 is subject to an alternating torque of the valve spring during a rotation thereof. This alternating torque is transmitted to the ring gear 202 thorough the sleeve 201 and makes it move in its axial direction. Therefore, varying a volume of the pressure chamber 203, 204 causes flow of the working fluid in a pulsing stream, and causes an adverse effect on the performance characteristics of the valve spool 11. Namely, due to the pulsing stream of the working fluid, the working fluid might leak from a contact-face between the first and second lands 30, 31 and the inner portion of the valve body 10, so that the valve spool 11 might not be operated exactly. Furthermore, the pulsing stream of the working fluid applies a variable force on the valve spool 11, and this might cause unexpected movement of the valve spool 11. However, in this embodiment, the first filters 38, 39 are disposed in the first and second passages 8, 9, respectively, so that the pulsing stream of the working fluid is effectively attenuated because of a flow resistance through the first filters 38, 39. Namely, the first filters 38, 39 act to damp and reduce the variation in the pulsing stream of the working fluid. Therefore, the valve spool 11 of the oil pressure apparatus in this embodiment is protected against the effect of the pulsing stream of the working fluid, thereby ensuring that the valve timing control device will perform correctly.

Figure 5:
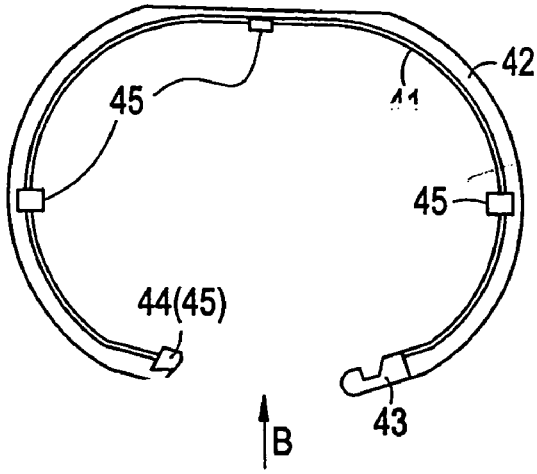
FIG. 5 shows a released condition of a filter shown in FIG. 3.
Figure 6:
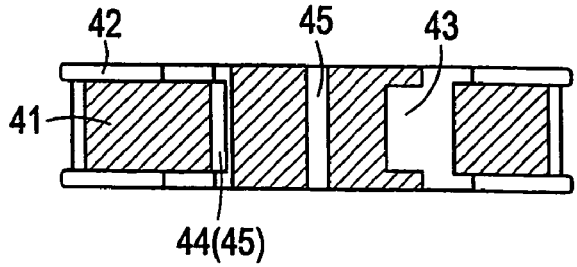
FIG. 6 shows a cross sectional view of the filter in the direction of arrow B in FIG. 5.
Figure 7:
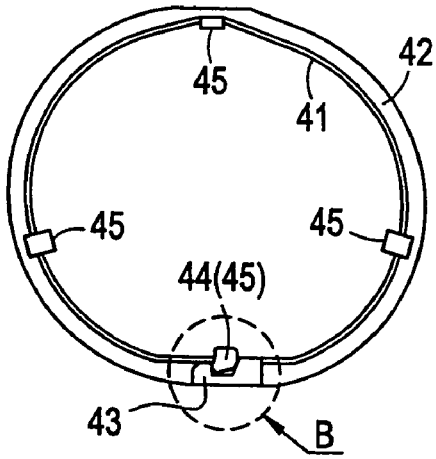
FIG. 7 shows a condition of a filter that is fitted to the control valve in FIG. 3.
Figure 8:
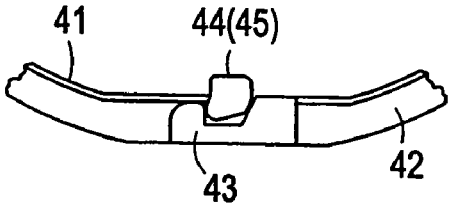
FIG. 8 is enlarged drawing, showing a cross sectional of the filter in the portion B in FIG. 7.

The second embodiment of the invention in FIG. 3-8 is similar to that above described, with the exception that it provides a different location of the first filters 38, 39. Since the other elements are identical to the previously described embodiments, like elements are given like reference characters. Namely, the first filters 38', 39' are fitted around the spool valve body 10 at a location corresponding to the first port 13 and the second port 14, respectively. Referring now to drawings, each of the first filters 38', 39' includes a filter portion 41 and a frame 42 that encloses the filter portion 41. As shown in FIG. 5, the first filters 38', 39' substantially have a C-shape in cross section, prior to being fitted around the valve body 10. The filter portion 41 is a net of fine mesh that is made of a metal material, and the frame 42 is made of a synthetic resin. As shown in FIGS. 5-8, the filters 38', 39' having a hook mechanism includes a hook 43 formed on one end of the filter and a projection 44 formed on the other end of the filter for being hooked on the hook 43. A plurality of crosspieces 45 are formed on the filter 38', 39' in the direction along its longitudinal axis and protrude therefrom for supporting the filter portion 41. One of the crosspieces 45 is formed on the other end of the filters 38', 39' for serving as a function of the projection 44. When the hook 43 is hooked to the projection 44, the filters 38', 39' are formed substantially as a ring in cross section. The first filters 38', 39' are fitted around respective slots 23, 24 of the valve body 10 for positioning accuracy in the direction along its longitudinal axis, thereby ensuring that the first filters 38', 39' are placed properly in the slots 23, 24, respectively. Moreover, since the C-shape of the first filters 38, 39 causes a tensile force, when the hook 43 and the projection 44 are hooked up, a tight binding between the hook 43 and the projection 44 is established.

In the operation of the second embodiment of the present invention, the working fluid introduced to the control valve 3 is filtered by the first filters 38', 39' and the second filter 37, thus, enabling the control valve to be operated smoothly. Moreover, the first filters 38, 39 are capable of reducing the variation in the pulsing stream of the working fluid. In addition, since the first filters 38', 39' are fitted around the first port 23 and the second port 24, respectively, the first filters 38', 39' can be assembled easily and can filter the working fluid passing throughout the entire first and second passages 8, 9. Further, the first filters 38', 39' having the frame 42, the crosspiece 45 and the hook mechanism 43, 44 are easily fitted around the valve body 10.

Figure 9:
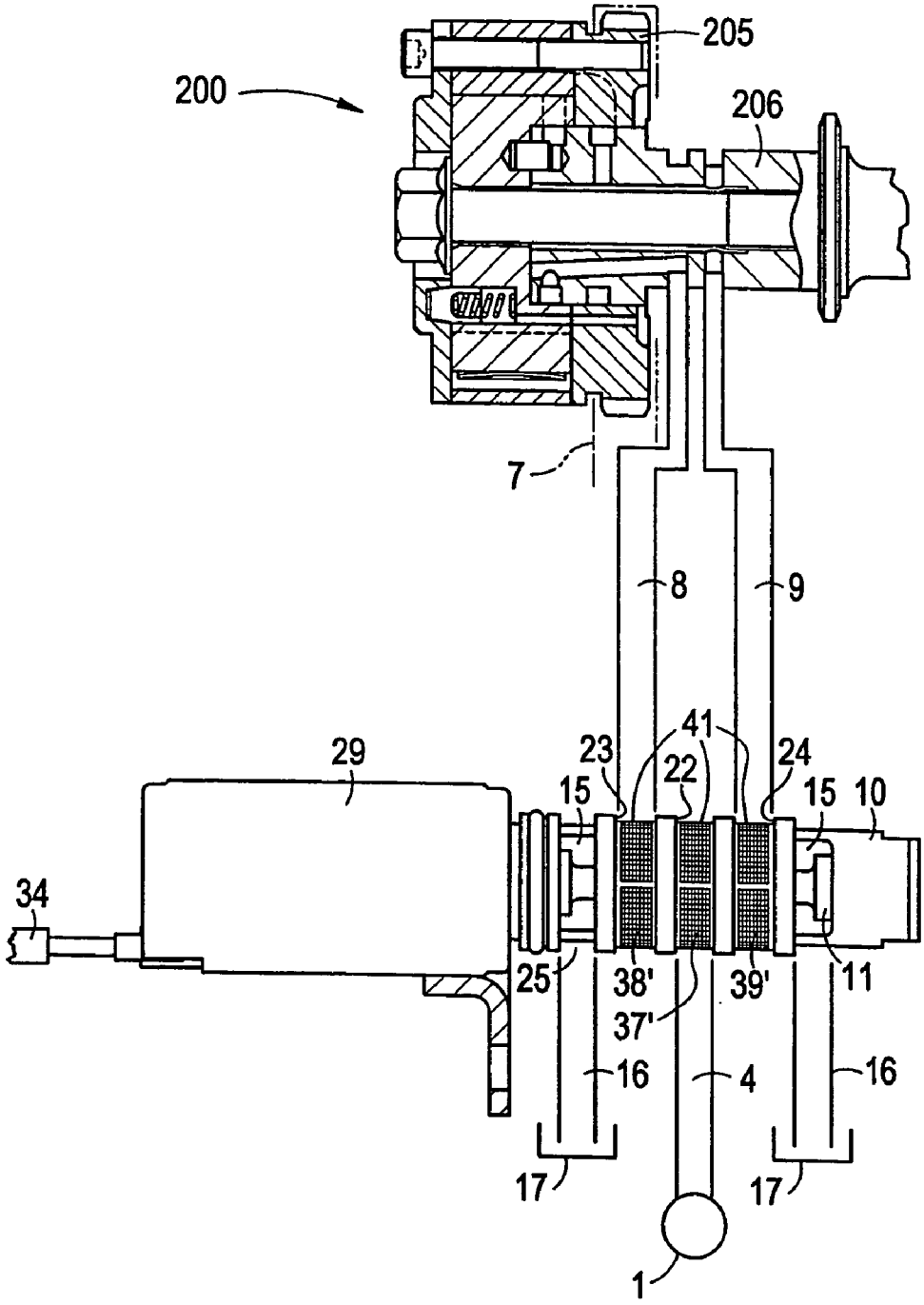
FIG. 9 is a combination of a schematic system and device sectional drawing, showing a hydraulic actuator as a valve timing control device in accordance with the third embodiment of the present invention.
Figure 10:
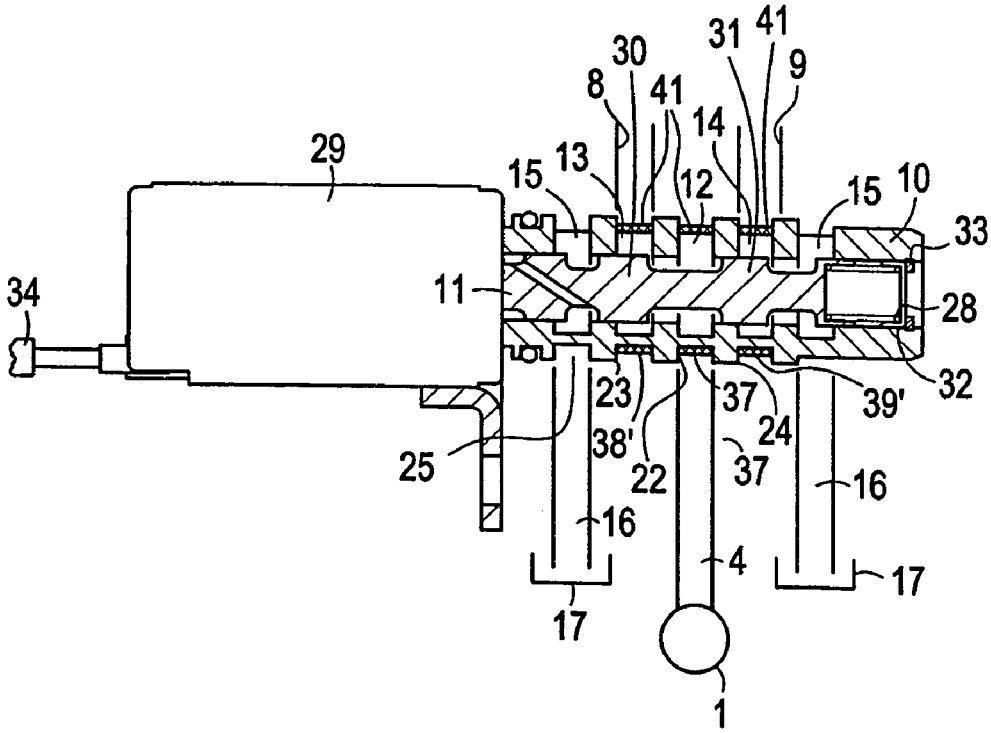
FIG. 10 is a sectional drawing, showing the control valve in FIG. 9.

FIG. 9 and FIG. 10 illustrate the third embodiment of the present invention in which the first filters 38', 39' and the second filter 37' are fitted around respective slots 23, 24, 22. Since the other elements of the control valve 3 are identical to the previously described embodiments, like elements are given like reference characters. With this embodiment, the actuator 200 is different type of valve timing device from that of the above described embodiments. The actuator 200 in third embodiment, is a so-called "a vane valve timing device" type, as described in U.S. Pat. No. 5,797,361, which is herein incorporated by reference. In this embodiment, the first and second filters 37', 38', 39' can share components with one another, so that this component sharing reduces production cost. The third embodiment also obtains the same function and advantage in the previously described embodiments.

Figure 11:
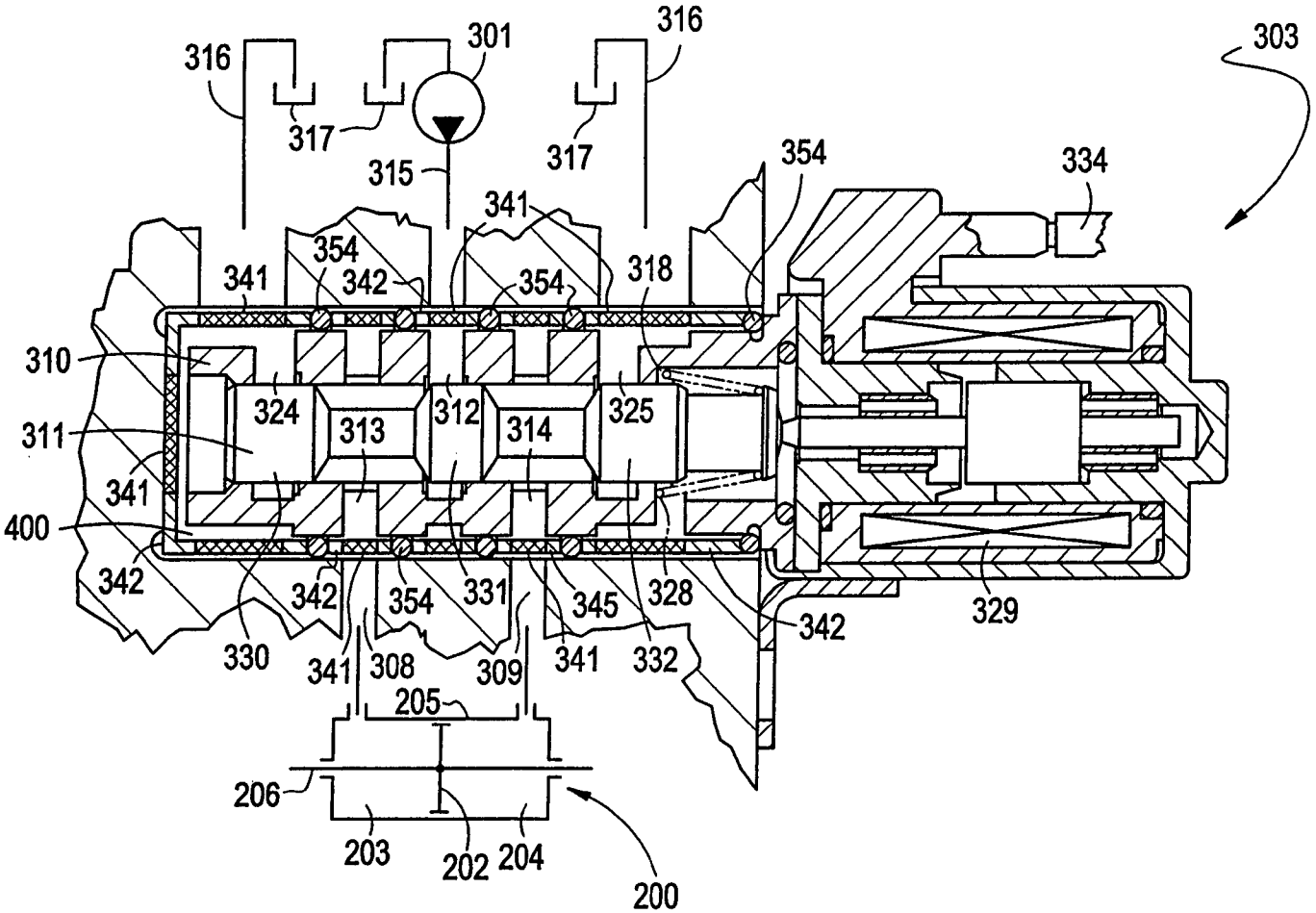
FIG. 11 is a combination of a schematic system and device sectional drawing, showing a hydraulic actuator as a valve timing control device in accordance with the forth embodiment of the present invention.
Figure 12:
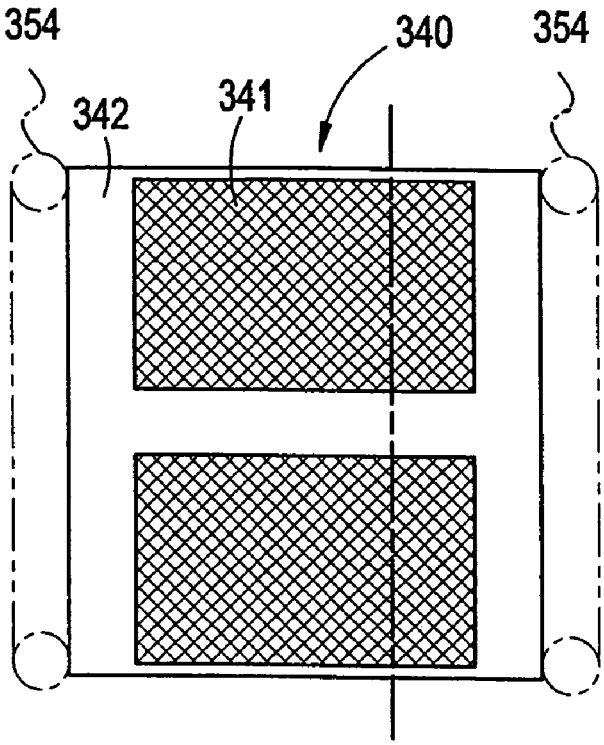
FIG. 12 is a front view of the filter in FIG. 11.
Figure 13:
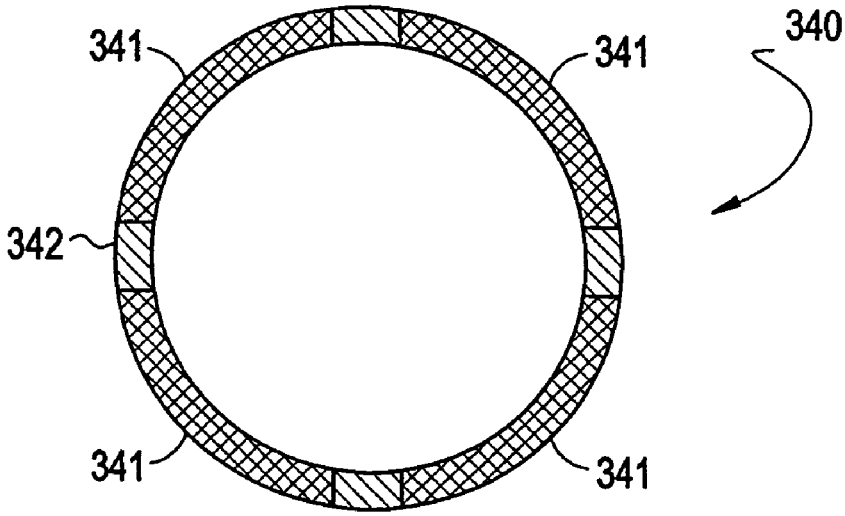
FIG. 13 shows a sectional view of the filter taken on line A-A of FIG. 12.

The fourth embodiment of the present invention, illustrated in FIG. 11-13 uses a modified filter. Since the other elements of the control valve 303 are identical to the previously described embodiments, like elements are given like reference characters. The actuator 200 depicted in functional diagrammatic form is the same as device in the previously described valve timing devices, such as the "gear" or the "vane valve timing device" type.

Referring now to the drawings, and particularly to FIG. 11, an accommodating bore 400 is formed in an engine housing, such as a cylinder head, a cylinder block and a cam cap that supports rotatably an upper surface of the camshaft 206 so as that a valve body 310 of the control valve 303 is fitted thereinto. The valve body 310 is shaped like a hollow-cylindrical item in order that a valve spool 311 is slidably inserted therein, and a supply 312, first 313, second 314 and drain ports 324, 325 are formed around an outer peripheral of the valve body 310, respectively. A supply passage 315 is provided to extend within the housing from the oil pump 301 to the supply port 312. Also, drain passages 316 are provided in the housing for connecting from a drain ports 324, 325 to a reservoir tank 317. First and second passages 308, 309 are provided in the housing for communicating from first and second ports 313, 314 to first and second pressure chambers 203, 204, respectively. A coil spring 328 is disposed between the end of the valve spool 311 and a step portion 318 for biasing the valve spool 311 toward an electro-magnetic solenoid 329. The electro-magnetic solenoid 329 having a terminal 334 is connected to a controller (not shown) and a battery (not shown) for actuating the spool valve 311 in accordance with engine conditions. The valve spool 311, having first, second and third lands 330, 331, 332, is actuated by the electro-magnetic solenoid 329 within the inner cylindrical portion of the valve body 310 for opening and closing the supply port 312, the first port 313, the second port 314 and the drain ports 315 with the first, second and third lands 330, 331, 332. The first land 330 and the second land 331 are capable of switching an oil flow among supply passage 304, the first passage 308 and the drain passage 316. The second land 331 and the third land 333 are also capable of switching an oil flow among supply passage 304, the second passage 309 and the drain port 316.

A filter 340, as shown in FIG. 12, comprises a filter portion 341 and a frame 342 that encloses the filter portion

341. The filter portion 341 is a net of fine mesh that is made of a metal material, and the frame 342 is made of a synthetic resin. The filter 340 is disposed between the inner surface of the bore 400 and the outer surface of the valve body 310, and the filter portions 341 are placed around corresponding to the supply, first, second, and drain ports 312, 313, 314, 324, 325, respectively. The filter 340 has a plurality of seals 354 that are placed between adjacent ports and prevent working oil leakage therefrom. The seals 354 are made of an elastic material, such as a rubber or a synthetic resin, and are disposed between the inner surface of the bore 400 and an outer peripheral of the valve body 310 with a squeezing ratio of 8 to 30%. Also, adjacent filters 340 are combined through the seals 354, when they are inserted into the bore 400, and shape like a tube as a whole. A modified embodiment of the filter mat be formed integrally with the adjacent filters. In this case, the seals 354 are disposed in both of an inner and outer surface of the filter.

The fourth embodiment also obtains the same function and advantage in the previously described embodiments. Especially, the seals 354 prevent leakage between the adjacent ports even if the control valve 303 is subject to the pulsing stream of the working fluid caused from alternating torque of the camshaft 206.

The present embodiments are to be considered as illustrative and not restrictive and the invention is not to be limited to the details given herein, but may be modified within the scope and equivalence of the appended claims.

The entire contents of basic Japanese Patent Application, No. 11-163584, filed Jun. 10, 1999, and Application No. 11-176,978, filed Jun. 23, 1999, from which priority is claimed, are herein incorporated by reference.

What is claimed is:

1. A valve timing control device for an internal combustion engine, comprising:

a source of hydraulic pressure;

a valve timing control mechanism controlling an opening and closing timing of at least one of an intake valve and an exhaust valve in an advancing direction or retarding direction by means of working fluid supplied from the source of hydraulic pressure;

a first passage through which the working fluid is supplied to the valve timing control mechanism to advance the opening and closing timing;

a second passage through which the working fluid is supplied to the valve timing control mechanism to retard the opening and closing timing;

a control valve disposed between the source of hydraulic pressure and the valve timing control mechanism, the control valve introducing and discharging the working fluid to and from one of the first passage and the second passage; and two substantially identical filters disposed in both of the first passage and the second passage, respectively, said filters being operative to (1) filter out contaminants generated at the passage between the valve timing control mechanism and the control valve and (2) provide a diffusion of fluid pulses.

2. The valve timing control device as claimed in claim 1, wherein each filter is disposed at a port of the control valve.

3. The valve timing control device as claimed in claim 2, wherein the control valve comprises:

a cylindrical valve body having a port which is in communication with the source of hydraulic pressure, a port which is in communication with the first passage, a port which is in communication with the second passage and a port which is in a communication with a drain passage, and a spool slidably received in the valve body, the spool being operable to open and close the ports of the valve body;

wherein each filter is fitted to the control valve.

4. The valve timing control device as claimed in claim 3, wherein the filter is disposed on a concave portion formed on an external surface of the valve body.

5. The valve timing control device as claimed in claim 4, wherein the filter is fitted to the control valve so as to be formed substantially as a ring in cross section.

6. The valve timing control device as claimed in claim 5, wherein the filter has a hook provided at one end of the filter and a hooked portion provided at the other end of the filter.

7. The valve timing control device as claimed in claim 6, wherein a tensile force is caused between the hook and the hooked portion when the hook is hooked on the hooked portion.

8. The valve timing control device as claimed in claim 7, wherein the filter comprises a filter portion and a frame portion provided around the filter portion, and the frame portion being made of a synthetic resin.

9. The valve timing control device as claimed in claim 3, wherein the spool is actuated by an electromagnetic solenoid.

10. A valve timing control device for an internal combustion engine, comprising:

a source of hydraulic pressure;

a valve timing control mechanism controlling an opening and closing timing of at least one of an intake valve and an exhaust valve in an advancing direction or retarding direction by means of working fluid supplied from the source of hydraulic pressure;

a first passage through which the working fluid is supplied to the valve timing control mechanism to advance the opening and closing timing;

a second passage through which the working fluid is supplied to the valve timing control mechanism to retard the opening and closing timing;

a control valve disposed between the source of hydraulic pressure and the valve timing control mechanism, the control valve introducing and discharging the working fluid to and from one of the first passage and the second passage; and identical filters disposed in the first passage, the second passage, a passage between the source of hydraulic pressure and the control valve and a passage between a reservoir and the control valve, respectively, at least two of said filters being operative to (1) filter out contaminants generated at the passage between the valve timing control mechanism and the control valve and (2) provide a diffusion of fluid pulses.

11. The valve timing control device as claimed in claim 10, wherein each filter is disposed at a port of the control valve.

12. The valve timing control device as claimed in claim 11, wherein the control valve comprises:

a cylindrical valve body having a port which is in communication with the source of hydraulic pressure, a port which is in communication with the first passage, a port which is in communication with the second passage and a port which is in communication with a drain passage, and a spool slidably received in the valve body, the spool being operable to open and close the ports of the valve body;

wherein each filter is fitted to the control valve.

13. The valve timing control device as claimed in claim 12, wherein the filter is disposed on a concave portion formed on an external surface of the valve body.

14. The valve timing control device as claimed in claim 13, wherein the filter is fitted to the control valve so as to be formed substantially as a ring in cross section.

15. The valve timing control device as claimed in claim 14, wherein the filter has a hook provided at one end of the filter and a hooked portion provided at the other end of the filter.

16. The valve timing control device as claimed in claim 15, wherein a tensile force is caused between the hook and the hooked portion when the hook is hooked on the hooked portion.

17. The valve timing control device as claimed in claim 16, wherein the filter comprises a filter portion and a frame portion provided around the filter portion, and the frame portion being made of a synthetic resin.

18. The valve timing control device as claimed in claim 12, wherein the spool is actuated by an electromagnetic solenoid.

* * * * *